US007997114B2

(12) United States Patent
Hüther

(10) Patent No.: US 7,997,114 B2
(45) Date of Patent: Aug. 16, 2011

(54) METHOD OF STAMPING MULTILAYER SHEETS

(75) Inventor: Andreas Hüther, Dippach (DE)

(73) Assignee: Material Sciences Corporation, Elk Grove Village, IL (US)

( * ) Notice: Subject to any disclaimer, the term of this patent is extended or adjusted under 35 U.S.C. 154(b) by 0 days.

(21) Appl. No.: 11/697,031

(22) Filed: Apr. 5, 2007

(65) Prior Publication Data

US 2008/0245126 A1 Oct. 9, 2008

(51) Int. Cl.
*B21D 31/02* (2006.01)
*B21D 28/26* (2006.01)

(52) U.S. Cl. ..... 72/327; 72/337

(58) Field of Classification Search ..... 72/332, 72/333, 337, 327, 363, 324, 325, 330, 331, 72/338; 83/686; 264/153, 155, 156, 160
See application file for complete search history.

(56) References Cited

U.S. PATENT DOCUMENTS

| | | | | |
|---|---|---|---|---|
| 1,861,648 | A * | 6/1932 | Vehko | 72/331 |
| 3,656,379 | A * | 4/1972 | Clark | 409/304 |
| 4,599,126 | A * | 7/1986 | Duffield | 156/268 |
| 5,702,556 | A * | 12/1997 | Okuma et al. | 156/261 |
| 6,401,510 | B1 * | 6/2002 | Morse et al. | 72/327 |

* cited by examiner

*Primary Examiner* — Debra M Sullivan
(74) *Attorney, Agent, or Firm* — Quinn Law Group, PLLC

(57) ABSTRACT

A method includes providing a sheet having layers characterized by different softnesses, providing a die component having a leading surface that is generally concave, and causing the leading surface to puncture the sheet thereby to cut a part from the sheet. The method provides improved flatness of parts cut from sheets having layers of varying softness and prevents soft material from exiting the sheet because the peripheral edge of the leading surface applies maximum pressure to the sheet during the puncturing step.

15 Claims, 4 Drawing Sheets

METHOD OF STAMPING MULTILAYER SHEETS

TECHNICAL FIELD

This invention relates to methods of stamping multilayer sheets with die components characterized by concave leading surfaces.

BACKGROUND OF THE INVENTION

Typically, stamping of metal sheets is performed using a stamping die with female and male components. The male component has a flat surface and fits tightly into a hole formed in the female component. When operating the die, the sheet to be cut is placed between the male and female components. When the male die component is forced into the hole of the female component, the male and female components cooperate to produce a shearing action on the metal sheet that cuts a part from the sheet. The shape of the part cut from the sheet is determined by the shape of the flat surface of the male component and the shape of the hole of the female component.

Certain sheets include one or more metal layers and one or more layers of material softer than the metal layer. For example, some multilayer sheets include two metal layers and a viscoelastic layer between the two metal layers configured to dampen vibrations. Other sheets may include an adhesive layer. When a sheet that includes a metal layer and layers of softer material is stamped, the pressure applied across the sheet by the flat surface of the male die component may cause the softer material, such as rubber or adhesive, to be forced out of the cut part. This may lead to adhesive build-up in the stamping die and cause the cut part to be outside a specified flatness tolerance.

SUMMARY OF THE INVENTION

A method for stamping multilayer sheets is provided. The method includes providing a sheet having a first layer comprised of a first material and a second layer comprised of a second material that is harder than the first material. The method further includes providing a die component characterized by a leading surface that is generally concave, and causing the leading surface of the die component to puncture the sheet, thereby to cut a part from the sheet.

Since the leading surface is concave, the perimeter of the leading surface applies maximum pressure to the sheet when the sheet is punctured, and thus the softer first material is prevented from being forced out of the punctured sheet. Accordingly, the method provided herein enables parts that are cut from sheets comprised of layers having different hardnesses and compressibilities to have improved flatness compared to the prior art. In exemplary embodiments, the first material is an elastomer, such as rubber or a viscoelastic material configured to dampen vibrations, and the second material is a metal.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
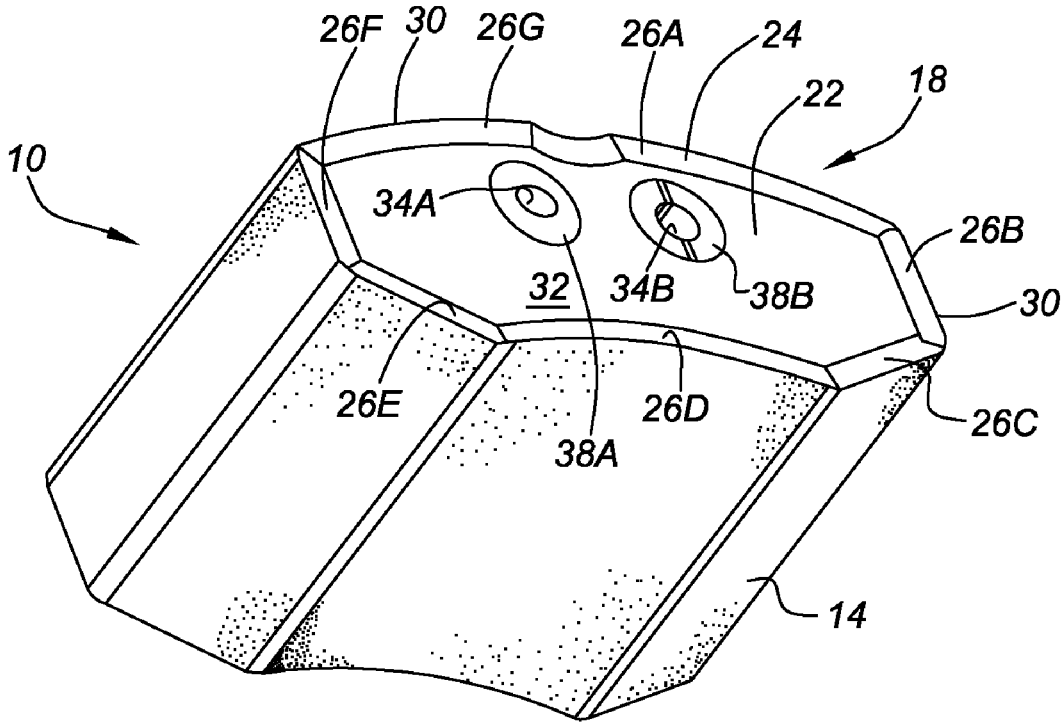
FIG. 1 is a schematic, perspective view of a male die component.
Figure 2:
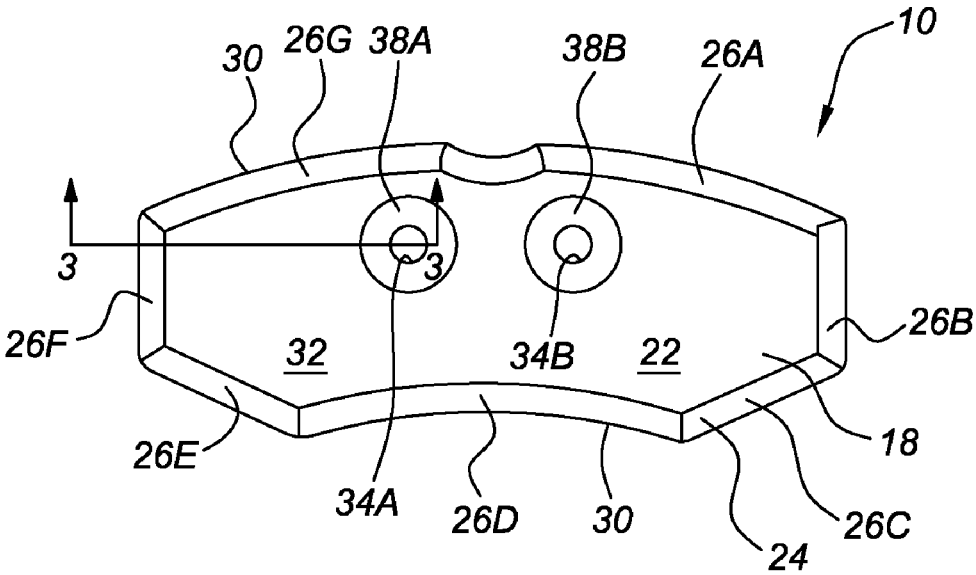
FIG. 2 is a schematic, plan view of the leading surface of the male die component of FIG. 1.

Referring to FIGS. 1 and 2, wherein like reference numbers refer to like components, a male die component 10 is schematically depicted. The male die component 10 is characterized by a body portion 14 and a leading surface 18. The leading surface 18 is characterized by a generally flat, central portion 22, a peripheral portion 24 circumscribing the central portion 22, and a leading edge 30 circumscribing the peripheral portion 24. The peripheral portion 24 in the embodiment depicted includes segments 26A-26G. The leading edge 30 protrudes further from the body 14 of the male die component 10 than the central portion 22, and the peripheral portion 24 interconnects the central portion 22 and the leading edge 30. Each segment 26A-G of the peripheral portion 24 is inclined such that the segments 26A-G become more protuberant from the body 14 as they extend radially outward from the central portion 22 toward the leading edge 30.

Accordingly, the leading surface 18 is generally concave, with the leading edge 30 being more protuberant than the central portion 22, and the peripheral portion 24 being angled to interconnect the central portion 22 and the leading edge 30. The central portion 22, the peripheral portion 24, and the leading edge 30 cooperate to define a concavity 32.

In the embodiment depicted, the male die component 10 also defines two holes 34A, 34B that extend through the body 14 of the component 10, and that are open at the leading surface 18. The portions 38A, 38B of the leading surface 18 immediately surrounding the holes 34A, 34B are protuberant from the central portion 22 of the leading surface 18. Within the scope of the claimed invention, a male die component may or may not define holes, and any holes defined by the male die component may be characterized by any size or shape.

Figure 3:
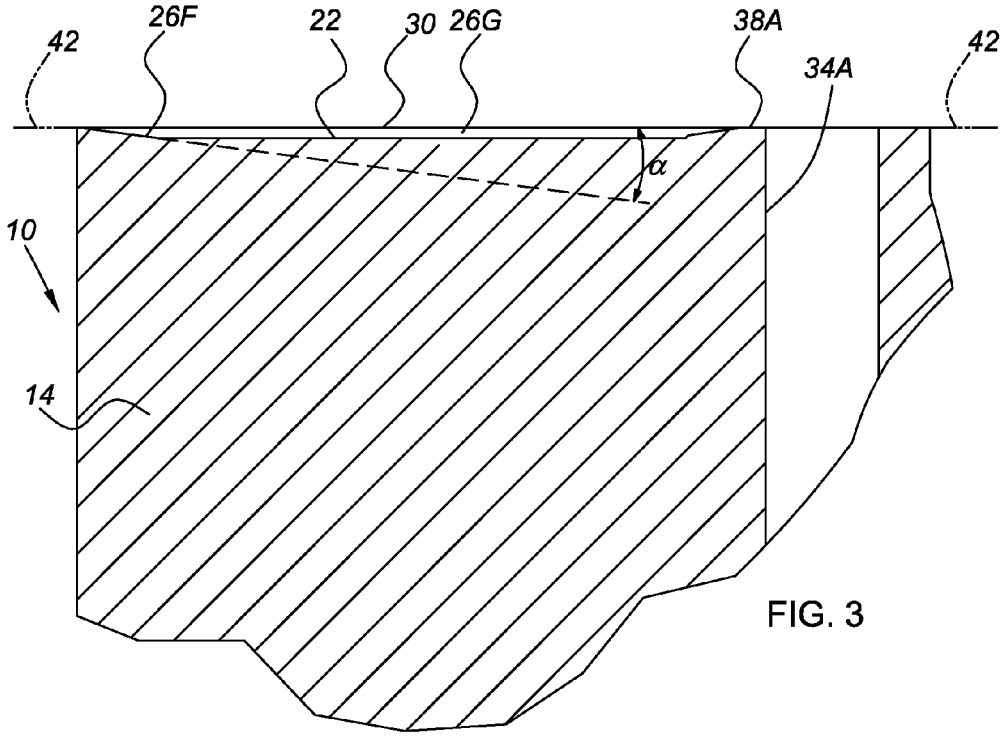
FIG. 3 is a schematic, sectional view of a portion of the male die component of FIG. 1.

Referring to FIG. 3, wherein like reference numbers refer to like components from FIGS. 1-2, at least a portion of the leading edge 30 is coplanar about a plane 42 that is parallel to the central portion 22. The leading edge 30, and therefore the plane 42, is spaced a distance apart from the central portion 22, which, in an exemplary embodiment, is 0.35 millimeters. The most protuberant part of portions 38A, 38B are coplanar with the leading edge 30 about plane 42. Segment 26F of the peripheral portion 24 defines an angle $\alpha$ with the plane 42. Angle $\alpha$ is at least five degrees, and $\alpha$ is preferably at least twelve degrees. In the embodiment depicted, $\alpha$ is twenty degrees. The relationship between segment 26F and the plane 42 is representative of the relationships between segments 26A-E, 26G and the plane 42. That is, each of the other segments 26A-E, 26G likewise define a respective angle with the plane 42 that is at least five degrees and preferably at least twelve degrees. The angles formed between each segment 26A-G of the peripheral portion 24 and the plane 42 may or may not be equal to one another within the scope of the claimed invention.

Figure 4:
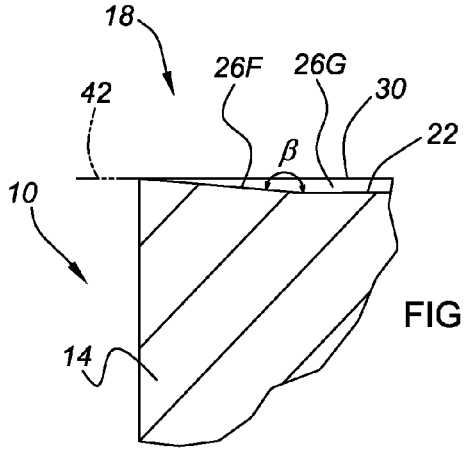
FIG. 4 is another schematic, sectional view of a portion of the male die component of FIG. 1.

Correspondingly, and with reference to FIG. 4, segment 26F of the peripheral portion 24 defines an angle β with the central portion 22 of the leading surface. Angle β is no greater than 175 degrees, and angle β is preferably no greater than 168 degrees. In the embodiment depicted, angle β is 160 degrees. The relationship between segment 26F and the central portion 22 of the leading surface 18 is representative of the relationships between the other segments 26A-E, 26G and the central portion 22. That is, each of the other segments 26A-E, 26G likewise define a respective angle with the central portion 22 that is no greater than 175 degrees and preferably no greater than 168 degrees. The angles formed between each segment 26A-G of the peripheral portion 24 and the central portion 22 may or may not be equal to one another within the scope of the claimed invention.

Figure 5:
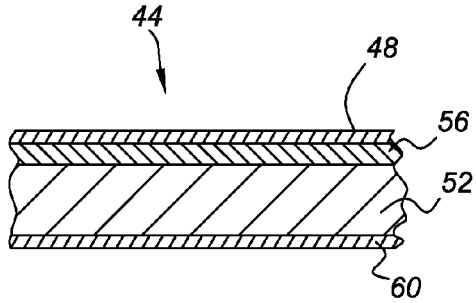
FIG. 5 is a schematic, cross-sectional view of a multilayer sheet.
Figure 6:
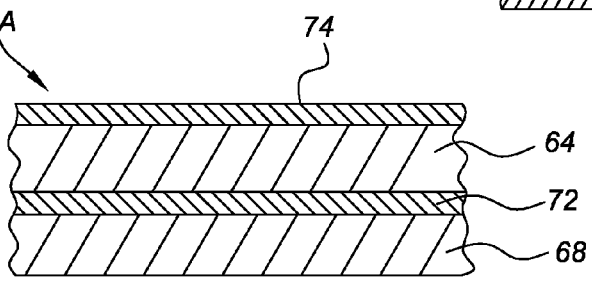
FIG. 6 is a schematic, cross-sectional view of another multilayer sheet.

Referring to FIG. 5, a cross section of a sheet 44 is schematically depicted. The sheet 44 is composed of multiple layers 48, 52, 56, 60. In an exemplary embodiment, layers 48 and 60 are comprised of adhesive, layer 52 is steel, and layer 56 is comprised of an elastomer, e.g., a textured rubber coating. Layers 48, 56, and 60 span the entirety of layer 52. In an exemplary embodiment, layers 48 and 60 are characterized by a thickness of approximately 0.051 mm, layer 52 is characterized by a thickness of 0.45 mm, and layer 56 is characterized by a thickness of 0.12 mm. As understood by those skilled in the art, steel is significantly harder, and less compressible, than rubber. Other multilayer sheet compositions may be employed within the scope of the claimed invention. For example, and with reference to FIG. 6, sheet 44A includes layers 64, 68, 72, and 74. Layers 64 and 68 are steel, layer 72 is comprised of a viscoelastic material, and layer 74 is comprised of an elastomer such as rubber.

Figure 7:
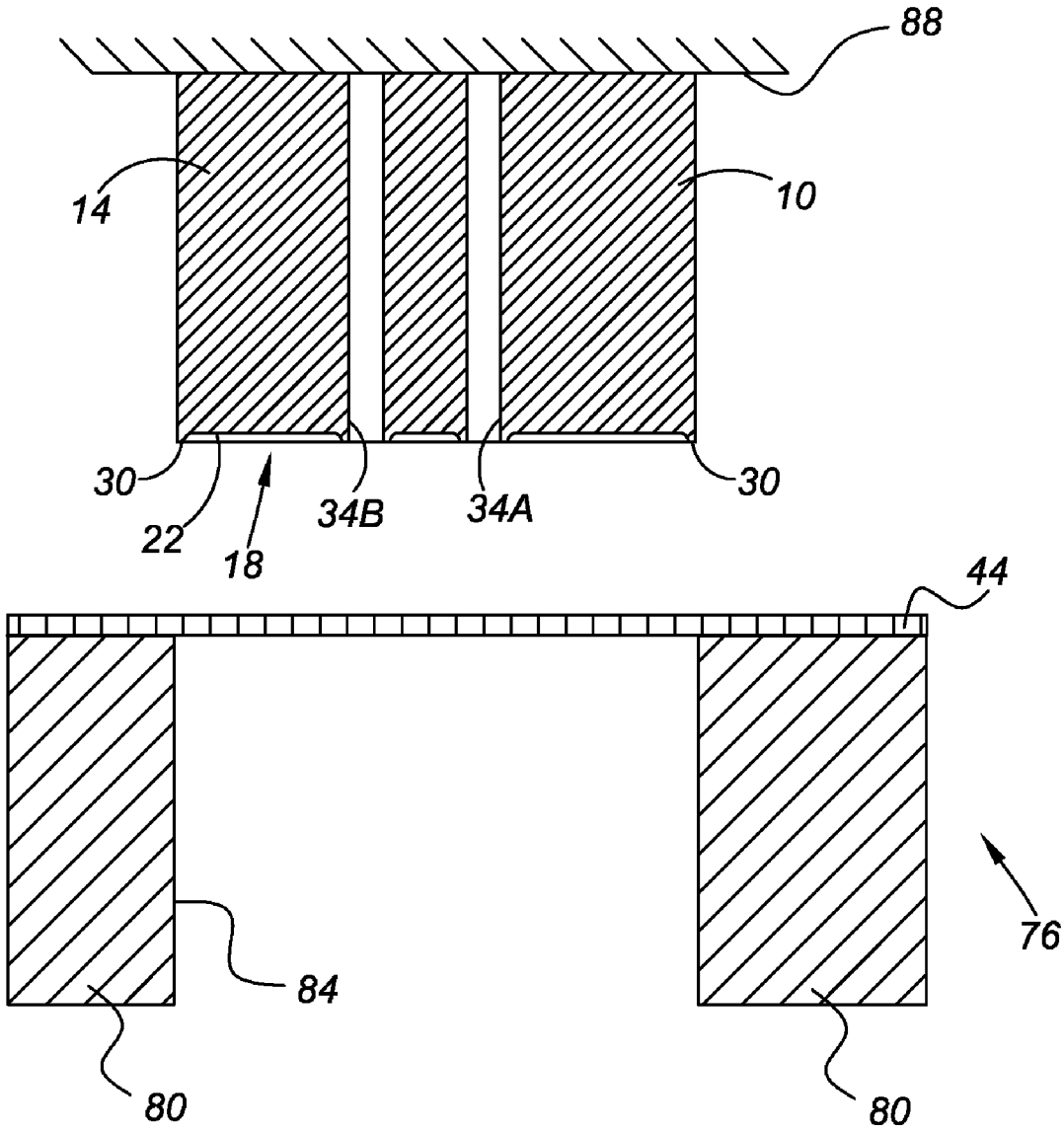
FIG. 7 is a schematic, cross-sectional view of a metal forming apparatus with the male die component of FIG. 1 in a first position and a multilayer sheet positioned for being punched by the male die component.
Figure 8:
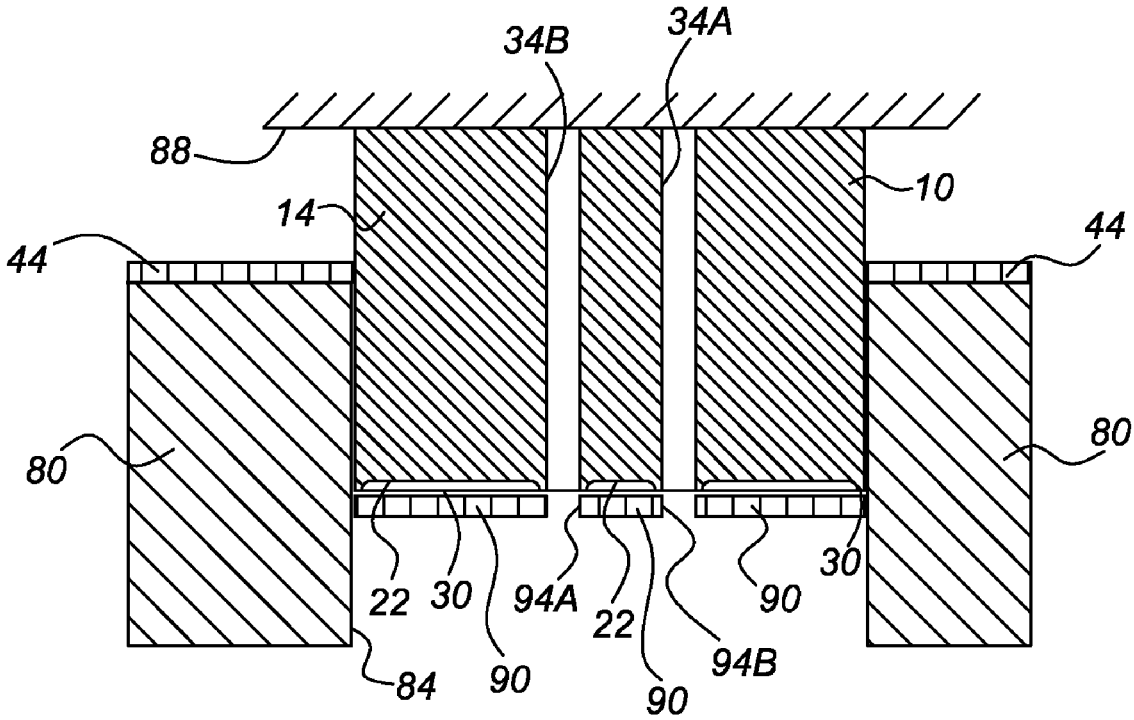
FIG. 8 is a schematic, cross-sectional view of the metal forming apparatus of FIG. 7 with the male die component in a second position such that a part has been cut from the multilayer sheet.

Referring to FIG. 7, wherein like reference numbers refer to like components from FIGS. 1-6, a metal forming apparatus 76 is schematically depicted. The metal forming apparatus 76 includes the male die component 10 and a female die component 80. The female die component 80 defines an aperture, namely hole 84, sufficiently sized and shaped to receive the male die component 10 therein. The male die component 10 is mounted to a press 88 that is configured to selectively move the male die component 10 between a first position, as shown in FIG. 7, in which no part of the male die component 10 is within the hole 84, and a second position, as shown in FIG. 8, in which the male die component 10 is at least partially within the hole 84 of the female die component 80. The male die component 10 is positioned such that the leading surface 18 faces the hole 84. Hole 84 is open in the direction of the die component 10.

During operation of the metal forming apparatus, the multi-layer sheet 44 is supported by the female die component 80 such that the sheet 44 spans the hole 84 and is positioned between the male die component 10 and the hole 84. The press 88 is activated to move the male die component to the second position. Referring to FIG. 8, as the male die component moves from the first position to the second position, the leading surface 18 contacts the sheet 44. Since the leading edge 30 is more protuberant than the other portions of the leading surface 18, the leading edge 30 contacts the sheet 44 before any other portion of the male die component 10. The central portion 22 of the leading surface is parallel to the surface of the sheet 44. As the male die component 10 moves to the second position, it punctures the sheet 44, thereby causing removal of a portion 90 of the sheet 44. More specifically, the male and female die components 10, 80 cause a shearing force on the sheet 44, which causes portion 90 to separate from the remainder of the sheet 44.

Portion 90 is configured as a brake shim, and is characterized by a perimeter that has the same shape as the leading edge 30 of the leading surface 18. The portion 90 also includes two holes 94A, 94B that are cut by portions 38A, 38B of the leading surface 18.

Within the scope of the claimed invention, the method disclosed herein may be employed in a single stage tool or a multistage tool in which a component is formed in a plurality of successive steps.

While the best modes for carrying out the invention have been described in detail, those familiar with the art to which this invention relates will recognize various alternative designs and embodiments for practicing the invention within the scope of the appended claims.

The invention claimed is:

1. A method comprising:

providing a sheet having a first layer comprised of a first material, a second layer comprised of a second material, and a third layer comprised of a third material, wherein the second material is harder than the first material and the third material;

wherein the first layer is of a uniform first thickness, the second layer is of a uniform second thickness, and the third layer is of a uniform third thickness;

wherein the second layer is between the first layer and the third layer;

providing a die component characterized by a leading surface that is generally concave;

wherein the leading surface includes a central portion, a leading edge, and a peripheral portion interconnecting the central portion and the leading edge; and wherein the central portion and the peripheral portion define an angle therebetween that is less than 175 degrees; and causing the leading surface of the die component to contact the uniform first thickness of the first layer such that the leading edge of the die component applies pressure to the first layer prior to puncturing through the uniform first thickness of the first layer, through the uniform second thickness of the second layer, and through the uniform third thickness of the third layer of the sheet thereby to cut a part from the sheet.

2. The method of claim 1, wherein the first material is one of a viscoelastic material and an elastomer and the second material is metal.

3. The method of claim 2, wherein the third material is one of an adhesive and an elastomer.

4. The method of claim 1, wherein the sheet further includes a fourth layer comprised of metal, and wherein one of the first and third layers is between the second and fourth layers.

5. The method of claim 1, wherein the central portion is substantially parallel with the surface of the sheet when the leading surface punctures the sheet.

6. The method of claim 1, wherein the angle is less than 168 degrees.

7. The method of claim 1, wherein the leading surface defines a hole, and wherein the portion of the leading surface surrounding the hole is protuberant.

8. A method comprising:

providing a sheet having a first layer comprised of a first material, a second layer comprised of a second material, and a third layer comprised of a third material, wherein the second material is harder than the first material and the third material;

wherein the first layer is of a uniform first thickness, the second layer is of a uniform second thickness, and the third layer is of a uniform third thickness;

wherein the second layer is between the first layer and the third layer;

providing a first die component defining an aperture;

providing a second die component selectively movable between a first position in which the second die component is not within the aperture and a second position in which the second die component is at least partially within the aperture; said second die component including a leading surface that is generally concave;

placing the sheet between the first die component and the second die component when the second die component is in the first position; and causing the second die component to move from the first position to the second position to apply pressure to the uniform first thickness of the first layer at a leading edge of the second die prior to puncturing through the uniform first thickness of the first layer, through the uniform second thickness of the second layer and through the uniform third thickness of the third layer such that a part is cut from the sheet.

9. The method of claim 8, wherein the first material is one of an elastomer and a viscoelastic, and the second material is metal.

10. The method of claim 9, wherein the third layer material is one of an adhesive and an elastomer.

11. The method of claim 8, wherein the sheet further includes a fourth layer comprised of metal, and wherein one of the first and third layers is between the second and fourth layers.

12. The method of claim 8, wherein the leading surface includes a central portion, a leading edge, and a peripheral portion interconnecting the central portion and the leading edge; and wherein the central portion is substantially parallel with the surface of the sheet during said causing the second die component to move from the first position to the second position.

13. The method of claim 12, wherein the central portion and the peripheral portion define an angle therebetween that is less than 175 degrees.

14. The method of claim 13, wherein the angle is less than 168 degrees.

15. A method of manufacturing a brake shim, the method comprising:

providing a sheet having a first layer comprised of steel, a second layer comprised of an elastomer, and a third layer comprised of adhesive;

wherein the first layer is of a uniform first thickness, the second layer is of a uniform second thickness and the third layer is of a uniform third thickness;

wherein the first layer is between the second layer and the third layer;

providing a first die component defining an aperture;

providing a second die component selectively movable between a first position in which the second die component is not within the aperture and a second position in which the second die component is at least partially within the aperture; said second die component including a leading surface defining first and second holes; said leading surface having a flat central portion, a leading edge circumscribing, and being more protuberant than, the central portion, and portions surrounding the first and second holes that are more protuberant than the central portion;

placing the sheet between the first die component and the second die component when the second die component is in the first position such that the sheet is substantially parallel with the central portion; and causing the second die component to move from the first position to the second position to apply pressure to the uniform first thickness of the first layer at the leading edge of the second die prior to puncturing through the uniform first thickness of the first layer, the uniform second thickness of the second layer and the uniform thickness of the third layer such that a part is cut from the sheet.

* * * * *